United States Patent [19]

Didchenko et al.

[11] 3,954,947

[45] May 4, 1976

[54] RAPID STABILIZATION OF POLYACRYLONITRILE FIBERS PRIOR TO CARBONIZATION

[75] Inventors: Rostislav Didchenko, Middleburg Heights; Charles D. Amata, Berea, both of Ohio

[73] Assignee: Union Carbide Corporation, New York, N.Y.

[22] Filed: Nov. 17, 1972

[21] Appl. No.: 307,616

[52] U.S. Cl. ..... 423/447; 8/115.5; 264/29

[51] Int. Cl. ..... C01b 31/07

[58] Field of Search ..... 423/447; 8/115.5; 264/29

[56] References Cited

UNITED STATES PATENTS

| | | | |
|---|---|---|---|
| 3,305,315 | 2/1967 | Bacon et al. | 423/447 |
| 3,337,301 | 8/1967 | McWhorter et al. | 423/447 |
| 3,427,120 | 2/1969 | Shindo et al. | 423/447 X |
| 3,441,378 | 4/1969 | Didchenko | 423/447 |
| 3,529,934 | 9/1970 | Shindo | 423/447 |
| 3,556,729 | 1/1971 | Holsten et al. | 423/447 |

OTHER PUBLICATIONS

Shindo et al., "Applied Polymer Symposia," No. 9, (1969), pp. 305–313.

*Primary Examiner*—Edward J. Meros
*Attorney, Agent, or Firm*—John S. Piscitello

[57] ABSTRACT

An improved process for producing carbon fibers by the pyrolysis of polyacrylonitrile fibers wherein the extended heat treatment heretofore required in order to stabilize the fiber structure so that it may be carbonized is completed in substantially shorter periods of time by effecting stabilization in an atmosphere containing both hydrogen chloride and oxygen. After the fibers have been thermally stabilized in this manner, they may be rapidly carbonized in times as short as one-half minute.

5 Claims, No Drawings

RAPID STABILIZATION OF POLYACRYLONITRILE FIBERS PRIOR TO CARBONIZATION

BACKGROUND OF THE INVENTION

1. Field of the Invention

This invention relates to an improved process for producing carbon fibers from fibers of polyacrylonitrile. More particularly, this invention relates to an improved process for producing carbon fibers by the pyrolysis of polyacrylonitrile fibers wherein the extended heat treatment heretofore required in order to stabilize the fiber structure so that it may be carbonized can be performed in substantially shorter periods of time.

2. Description of the Prior Art

As a result of the rapidly expanding growth of the aircraft, space and missile industries in recent years, a need was created for materials exhibiting a unique and extraordinary combination of physical properties. Thus, materials characterized by high strength and stiffness, and at the same time of light weight, were required for use in such applications as the fabrication of aircraft structures, re-entry vehicles, and space vehicles, as well as in the preparation of marine deep-submergence pressure vessels and like structures. Existing technology was incapable of supplying such materials and the search to satisfy this need centered about the fabrication of composite articles.

One of the most promising materials suggested for use in composite form was high-strength, high-modulus carbon textiles, which were introduced into the market place at the very time this rapid growth in the aircraft, space and missile industries was occurring. Such textiles have been incorporated in both plastic and metal matrices to produce composites having extraordinary high-strength- and high-modulus-to-weight ratios and other exceptional properties. However, the high cost of producing the high-strength, high-modulus carbon textiles employed in such composites has been a major deterrent to their widespread use, in spite of the remarkable properties exhibited by such composites.

One suggested method of providing high modulus, high strength carbon fibers is described by Johnson et al. in U.S. Letters Pat. No. 3,412,062, entitled "Production of Carbon Fibers and Compositions Containing Said Fibers". Such method comprises heating polyacrylonitrile fiber under tension in an oxidizing atmosphere at a temperature of from 200° C. to 250° C. for a time sufficient to achieve substantially complete permeation of oxygen throughout the fiber, and then carbonizing the oxidized fiber in a non-oxidizing atmosphere to produce a fiber having a high tensile strength and Young's modulus. However, lengthy heat treatment times under oxygen are required by that process, e.g., of the order of at least several hours to 24 hours or more, in order to completely permeate the fiber with oxygen and achieve sufficient stabilization of the fiber structure so that it may be carbonized to produce carbon fibers having properties acceptable for commercial use. Such extended heat treatment times, however, reduce production output and require substantial capital investment, rendering the process unattractive for commercial operations. For this reason, means have been sought for reducing the heat treatment times necessary to stabilize these fibers before they can be carbonized.

According to U.S. Letters Pat. No. 3,529,934, entitled "Process For The Preparation of Carbon Fibers", to Akio Shindo, improved quality carbon fibers can be prepared in high yields from cellulosic, polyvinyl alcohol and acrylic fibers, by heat treating the fibers under tension in an inert atmosphere containing gaseous hydrogen chloride. As in the case of the process suggested by Johnson et al., however, lengthy heat treatments are required in order to produce carbon fibers having properties acceptable for commercial use.

Rostislav Didchenko in U.S. Letters Pat. No. 3,441,378, entitled "Process For The Manufacture of Carbon Textiles", has also suggested that carbon textiles can be obtained from cellulosic textiles in improved yields by heating a cellulosic textile to a temperature up to about 400° C. in an atmosphere containing a hygroscopic gas which reacts with cellulose as a dehydrating agent to form cellulosic intermediates which upon subsequent carbonization yield close to theoretical amounts of carbon. Among the reactive gases mentioned in the patent is hydrogen chloride which, it is said, may be employed together with air as the reactive atmosphere. However, the use of hygroscopic gases like hydrogen chloride with oxygen to effect stabilization of the fiber structure of other carbonizable organic fibers not capable of being dehydrated by such gases, such as polyacrylonitrile, has not been suggested.

SUMMARY OF THE INVENTION

In accordance with the present invention, it has now been discovered that polyacrylonitrile fibers can be thermally stabilized prior to carbonization in substantially shorter periods of time than heretofore possible if the atmosphere in which stabilization is effected contains both gaseous hydrogen chloride and oxygen; and that the fibers so stabilized can be rapidly carbonized, in times as short as one-half minute, without detrimental effects on the properties of the resultant carbon fibers. The synergistic effect which the two reactive components of the heat treating atmosphere, oxygen and hydrogen chloride, exert on each other in effecting thermosetting of polyacrylonitrile fibers is totally unexpected as extended heat treatment times are required to effect thermal stabilization of such fibers when each of these materials is employed alone.

Not only is the process of this invention attractive commercially because it substantially reduces the time necessary to effect stabilization of the fibers but also because it has been found that when the stabilized fibers are carbonized to produce a substantially all-carbon fiber, the carbonized fibers possess better handling characteristics, e.g., better drape, and, unexpectedly, are often characterized by improved physical properties compared to carbon fibers prepared in a similar manner but stabilized in an oxygen-containing atmosphere which does not contain hydrogen chloride, or in a hydrogen chloride-containing atmosphere which is free of oxygen. Thus, in addition to improved drape, carbon fibers prepared from polyacrylonitrile fibers which have been stabilized in the presence of both hydrogen chloride and oxygen according to the invention are characterized by Young's moduli and tensile strengths which are at least as good and often higher than those of carbon fibers produced in a similar manner but stabilized in an oxygen-containing atmosphere which does not contain hydrogen chloride, or in a hydrogen chloride-containing atmosphere which is free of oxygen. Generally, carbon fibers having a tensile strength in excess of 250 × $10^3$ psi. and a Young's modulus in excess of 30 × $10^6$ psi. can be produced in a total time of less than one-half hour according to the present invention by thermally stabilizing polyacrylonitrile fibers in less than 30 minutes and then rapidly carbonizing the stabilized fibers in about one-half minute.

DESCRIPTION OF THE PREFERRED EMBODIMENTS

According to the present invention, the fiber structure of polyacrylonitrile fibers can be thermally stabilized in substantially shorter periods of time than heretofore possible if the atmosphere in which stabilization is effected consists essentially of hydrogen chloride in an amount of from 5 volume percent to 50 volume percent, preferably from 20 volume percent to 40 volume percent, and from 50 volume per cent to 95 volume percent of oxygen, preferably from 60 volume percent to 80 volume percent.

A tension at least sufficient to prevent longitudinal shrinkage of the fibers is applied to the fibers during this heat stabilization treatment. When a continuous filament is being processed, as is preferred, the filament is fed through a furnace containing the desired atmosphere by means of a payoff reel and a take-up reel which are operated at equal speed so as to prevent fiber shrinkage.

The time required to effect stabilization in a given instance will, of course, be affected by the relative amounts of hydrogen chloride and oxygen present in the atmosphere in which stabilization is effected, as well as upon such other factors as the temperature employed and the diameter of the fibers. Although greater reductions in stabilization times can be effected when larger concentrations of hydrogen chloride are employed, in order to retain adequate fiber strength, it is necessary that the atmosphere in which stabilization is effected contain no more than 50 volume percent hydrogen chloride. Above such concentrations of hydrogen chloride, a decrease in fiber strength occurs when the fibers are treated under the conditions set forth herein.

In order to ensure that all the polyacrylonitrile fibers are effectively subjected to the action of the hydrogen chloride-oxygen atmosphere, the gas flow of the hydrogen chloride-oxygen atmosphere over the fibers should be adequate to permit full diffusion of the gas into the fibers and effect removal of all reaction products from the surface of the fibers. If the gas flow rate is too slow, poorly thermoset fibers and/or ignition of fiber volatiles and the fibers may result.

A minimum temperature of at least 200°C. is generally necessary to effectively stabilize polyacrylonitrile fibers in an atmosphere containing gaseous hydrogen chloride and oxygen. At higher temperatures, of course, fibers of a given diameter can be stabilized in less time than is possible at lower temperatures. In order to prevent melting and/or excessive burn-off of the fibers, however, it is necessary, at least initially, to heat treat the fibers at a temperature no higher than 270°C. Preferably, temperatures of from about 250°C. to about 260°C. are employed for this initial heat treat. After the fibers have been heated between 10 to 15 minutes at such temperatures, they are further heated at a temperature of from above about 270°C. to about 380°C., preferably from about 330°C. to about 360°C. for an additional 10 to 15 minutes.

After the fibers have been stabilized as described above, they are capable of being rapidly carbonized, in times as short as one-half minute, without detrimental effects on the resultant fiber properties. Carbonization is effected by heating in an inert atmosphere to a temperature sufficiently elevated to remove hydrogen and other volatiles and produce a substantially all-carbon fiber. By an inert atmosphere is meant an atmosphere which does not react with the fibers under the heating conditions employed, such as nitrogen, argon, xenon, helium and the like. Fibers having a carbon content greater than about 98 percent by weight can generally be produced by heating to a temperature in excess of about 1000°C., and at temperatures in excess of about 1400°C., the fibers are completely carbonized.

Usually, carbonization is effected at a temperature of from about 1000°C. to about 2000°C., preferably from about 1400°C. to about 1700°C. At 1400°C., carbonization can be effected in about one-half minute. While more extended heating times can be employed with good results, such residence times are uneconomical and, as a practical matter, there is no advantage in employing such long periods.

If desired, the carbonized fibers may be further heated in an inert atmosphere, as described hereinbefore, to a still higher temperature in a range of from about 2500° C. to about 3300°C., preferably from about 2800°C. to about 3000°C. A residence time of about 1 minute is satisfactory, although both shorter and longer times may be employed, e.g., from about 10 seconds to about 5 minutes, or longer. Residence times longer than 5 minutes are uneconomical and unnecessary, but may be employed if desired. If desired, tension may be applied to the fibers during this additional heating stage so as to elongate the fibers and further enhance their physical properties.

The following examples are set forth for purposes of illustration so that those skilled in the art may better understand this invention, and it should be understood that they are not to be construed as limiting this invention in any manner. The term "carbon" as used throughout this specification includes all forms of the material, both graphitic and non-graphitic. By the term "polyacrylonitrile" as used throughout this specification is meant homopolymers and interpolymers of acrylonitrile containing at least 85 percent by weight of polymerized acrylonitrile. The term "fiber" as used herein includes all filamentary textile forms, i.e., felt, cloth, tow, yarn and the like.

EXAMPLE 1

A continuous filament of polyacrylontrile having a denier per filament of 1.5 was continuously fed through a tubular quartz furnace having a hot zone 30 cm. long and an inner diameter of 20 mm. The furnace was maintained at a temperature of 257°C. and the residence time of the filament in the furnace was 13 minutes. A mixture containing 20 volume percent hydrogen chloride and 80 volume percent oxygen was continuously passed through the furnace counter to the direction of yarn flow at a rate of 2 scfh. The filament was fed through the furnace from a payoff reel and taken up on a take-up reel. The reels were operated at a 1:1 ratio so that the only tension the filament was under was that resulting from the operation of the take-up reel.

The filament was then passed through the same furnace a second time and the process was repeated except that the furnace was maintained at a temperature of 341°C. the second time.

The resulting fiber was strong and flexible, and sufficiently stabilized so that it could be heated at elevated temperatures without sagging. This fiber was then carbonized by continuously feeding the fiber through a tubular quartz furnace by means of a payoff reel and a take-up reel. The furnace had a hot zone 25 cm. long and an inner diameter of 20 mm. and was maintained at a temperature of 1400°C. Nitrogen was continuously passed through the furnace at a rate of 2 scfh. Residence time of the filament in the hot zone was one-half minute. The payoff and take-up reels were operated at a ratio of 0.95 to take up any slack in the fiber caused by shrinkage during carbonization.

The carbonized fiber was flexible and strong, and had a tensile strength of $388 \times 10^3$ psi. and a Young's modulus of $34 \times 10^6$ psi. (Tensile strength and Young's modulus are an average of 10 samples).

EXAMPLE 2

A continuous filament of polyacrylonitrile having a denier per filament of 1.5 was continuously fed through a tubular quartz furnace having a hot zone 30 cm. long and an inner diameter of 20 mm. The furnace was maintained at a temperature of 255°C. and the residence time of the filament in the furnace was 13 minutes. A mixture containing 20 volume percent hydrogen chloride and 80 volume percent oxygen was continuously passed through the furnace counter to the direction of yarn flow at a rate of 2 scfh. The filament was fed through the furnace from a payoff reel and taken up on a take-up reel. The reels were operated at a 1:1 ratio so that the only tension the filament was under was that resulting from the operation of the take-up reel.

The filament was then passed through the same furnace a second time and the process was repeated except that the furnace was maintained at a temperature of 355°C. the second time and the residence time of the filament in the furnace was 12 minutes.

The resulting fiber was strong and flexible, and sufficiently stabilized so that it could be heated at elevated temperatures without sagging. This fiber was then carbonized by continuously feeding the fiber through a tubular quartz furnace by means of a payoff reel and a take-up reel. The furnace had a hot zone 25 cm. long and an inner diameter of 20 mm. and was maintained at a temperature of 1400°C. Nitrogen was continuously passed through the furnace at a rate of 2 scfh. Residence time of the filament in the hot zone was one-half minute. The payoff and take-up reels were operated at a ratio of 0.95 to take up any slack in the fiber caused by shrinkage during carbonization.

The carbonized fiber was flexible and strong, and had a tensile strength of $400 \times 10^3$ psi. and a Young's modulus of $33 \times 10^6$ psi. (Tensile strength and Young's modulus are an average of 10 samples).

EXAMPLE 3

In order to demonstrate the more rapid oxidation of polyacrylonitrile fibers which occurs when they are heated in an atmosphere containing both hydrogen chloride and oxygen, as compared to oxygen alone, samples of polyacrylonitrile fibers having a denier per filament of 1.5 were heated in each of these atmospheres at 254°C. for 13 minutes. Analysis of the fiber heated in oxygen alone showed an increase in its oxygen content of 4.2 percent. Analysis of the fiber heated in an atmosphere containing both hydrogen chloride and oxygen showed an increase in its oxygen content of 14.7 percent.

What is claimed is:

1. A process for producing carbon fiber by the pyrolysis of polyacrylonitrile fiber which comprises heating polyacrylonitrile fiber in an atmosphere consisting essentially of from 5 volume percent to 50 volume percent hydrogen chloride and from 50 volume percent to 95 volume percent oxygen, under tension at least sufficient to prevent longitudinal shrinkage of the fiber, first at a temperature of from 200°C. to 270°C. for from 10 to 15 minutes, and then at a temperature of from above 270°C. to 380°C. for an additional 10 to 15 minutes, and subsequently carbonizing the so-treated fiber in an inert atmosphere at a temperature of from 1000°C. to 2000°C., the total processing time required for the production of said carbon fiber not exceeding one-half hour.

2. A process as in claim 1 wherein the polyacrylonitrile fiber is heated first at a temperature of from 250°C. to 260°C. for from 10 to 15 minutes, and then at a temperature of from 330°C. to 380°C. for an additional 10 to 15 minutes prior to carbonization.

3. A process as in claim 1 wherein the polyacrylonitrile fiber is heated in an atmosphere consisting essentially of from 20 volume percent to 40 volume percent hydrogen chloride and from 60 volume percent to 80 volume percent oxygen prior to carbonization.

4. A process as in claim 3 wherein the polyacrylonitrile fiber is heated first at a temperature of from 250°C. to 260°C. for from 10 to 15 minutes, and then at a temperature of from 330°C. to 380°C. for an additional 10 to 15 minutes prior to carbonization.

5. A process as in claim 4 wherein carbonization is effected at a temperature of from 1400°C. to 1700°C.

* * * * *